United States Patent [19]

Ulrich

[11] 4,398,445

[45] Aug. 16, 1983

[54] GUN MUZZLE CLAMP

[75] Inventor: George W. Ulrich, St. Louis County, Mo.

[73] Assignee: The United States of America as represented by the Secretary of the Navy, Washington, D.C.

[21] Appl. No.: 296,719

[22] Filed: Aug. 27, 1981

[51] Int. Cl.[3] ..... B64D 7/06; F41F 17/12

[52] U.S. Cl. ..... 89/14 C; 89/12; 89/37.5 E

[58] Field of Search ..... 89/12, 9, 14 R, 14 B, 89/14 C, 14 D, 37 R, 37 B, 37.5 E, 1 L, 160, 37.5 R

[56] References Cited

U.S. PATENT DOCUMENTS

| | | | |
|---|---|---|---|
| 861,370 | 7/1907 | Lansden, Jr. | 384/289 |
| 1,413,903 | 4/1922 | Czegka | 89/14 B X |
| 2,048,763 | 7/1936 | Whiteley | 308/125 |
| 2,629,958 | 3/1953 | Roper et al. | 89/14 C X |
| 2,849,921 | 9/1958 | Otto | 89/12 |
| 2,898,811 | 8/1959 | Helble | 89/37 |
| 3,703,122 | 11/1972 | Farrington et al. | 89/160 X |
| 3,897,714 | 8/1975 | Perrin et al. | 89/12 |
| 3,898,910 | 8/1975 | Groff | 89/14 C |
| 4,121,496 | 10/1978 | Clayson | 89/14 C X |
| 4,179,978 | 12/1979 | Kirkpatrick et al. | 89/12 |
| 4,259,891 | 4/1981 | Rosenzweig | 89/12 |

OTHER PUBLICATIONS

NAVAIR 11-95M61A1-1 Technical Manual, MG1A1 20 mm Automatic Gun, pp. 2-2, 2-3 & 9-6, 8-1-69.

*Primary Examiner*—David H. Brown

[57] ABSTRACT

An improved gun muzzle clamp is provided for a Gatling type gun to reduce friction and increase durability in a high temperature, gunfire environment. The clamp assembly surrounds 6 gun barrels and supports the barrels at two independent bearing surfaces. One supporting arrangement consists of a plurality of bearings which rotate around the inner periphery of a blast diffuser and the other supporting arrangement is comprised of an annular ring which holds a piston ring gun gas seal.

5 Claims, 7 Drawing Figures

GUN MUZZLE CLAMP

BACKGROUND OF THE INVENTION

The present invention relates to a muzzle clamp for retaining and supporting the barrels in a rotating Gatling type gun.

The use of muzzle clamps for Gatling type guns is well-established. One such muzzle clamp is shown and described in U.S. Pat. No. 4,179,978, entitled, "Clamp", which issued Dec. 25, 1979, to Robert G. Kirkpatrick and Ronald R. Snyder. In this patent, a mid-barrel clamp assembly and three additional clamp assemblies are provided to lock each barrel in the cluster against rotation about its own longitudinal axis and to minimize relative transverse movement of each of the barrels. Other muzzle clamps are shown and described in U.S. Pat. No. 2,898,811 which issued Aug. 11, 1959, to D. R. Helble; in U.S. Pat. No. 2,849,921, which issued Apr. 2, 1954, to Harold Otto; and in U.S. Pat. No. 3,897,714, which issued Aug. 5, 1975, to David Perrin et al.

SUMMARY OF THE INVENTION

The present invention relates to a muzzle clamp for a Gatling type gun. A blast diffuser is provided on the end of a Gatling type gun and a pair of spaced bearing surfaces are attached inside the blast diffuser. A gun muzzle clamp assembly is clamped around 6 rotating gun barrels and the muzzle clamp assembly is provided with two supporting arrangements which engage the two bearing surfaces inside the blast diffuser. One supporting arrangement is comprised of a plurality of roller bearings which are carried by the clamp assembly and the other supporting arrangement is comprised of an annular ring which holds a piston ring gas seal. The blast diffuser is stationarily mounted to an aircraft, and the clamp assembly rotates with the gun barrels and is supported by the blast diffuser.

It is therefore a general object of the present invention to provide an improved muzzle clamp for a Gatling type gun.

Another object of the present invention is to provide a muzzle clamp for a machine gun which rotatably supports the barrels inside a blast diffuser and serves as a gas seal.

Other objects and advantages of the present invention will become apparent from the following detailed description of the invention when considered in conjunction with the accompanying drawings.

DESCRIPTION OF THE PREFERRED EMBODIMENT

Figure 1:
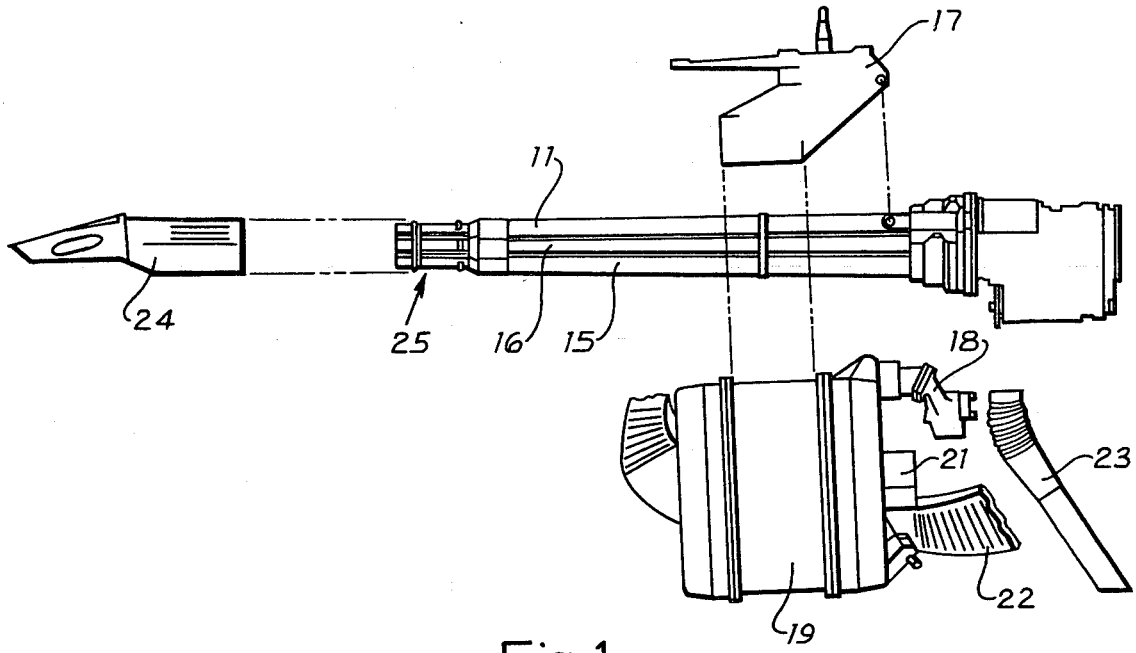
FIG. 1 is an exploded view showing the main parts of a Gatling type gun for use on an aircraft.

Referring first to FIG. 1 of the drawings, major components of an airborne Gatling gun are shown. The gun depicted has six, 20 mm barrels 11–16 and other major components are the pallet 17, hydraulic drive 18, ammunition container 19, control box 21, return chute 22, and breech purge duct 23. A blast diffuser 24 and gun muzzle clamp 25, which are the subject of the present invention are also shown.

Figure 7:
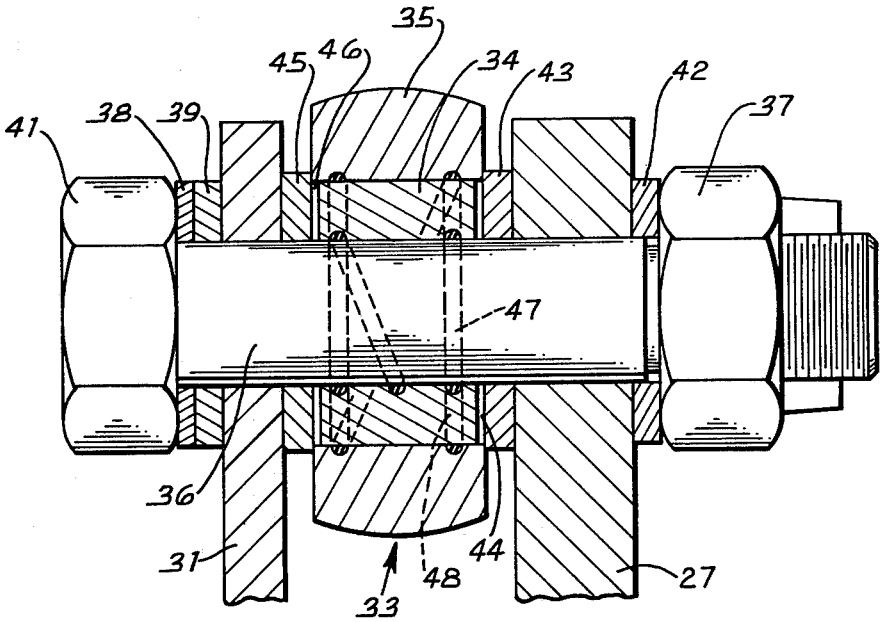
FIG. 7 is a partial sectional view showing a support bearing.

Referring now to FIGS. 2–5 of the drawings, gun muzzle clamp 25 is comprised of a front plate 26 and an aft plate 27 which are connected by three stiffners 28, 29, and 30 which are attached, as by welding, to plates 26 and 27. A support plate 31 which has a plurality of holes 32 for receiving barrels 11–16, is provided at the aft end of muzzle clamp 25 and six rotatable bearings 33 are positioned between aft plate 27 and support plate 31. As best shown in FIG. 7 of the drawings, each bearing 33 is comprised of a bushing 34, which might be made of aluminum bronze, and an outer bearing 35 of high strength material. Bushing 34 is rotatably mounted by bolt 36 which is supported by plates 27 and 31 and secured by nut 37. Standard washers 38 and 39 are provided between plate 31 and head 41 of bolt 36 and washer 42 is provided between plate 27 and nut 37. Outer bearing 35 is wider than bushing 34 and a washer 43 greater in diameter than the diameter of bushing 34 is positioned between aft plate 27 and bearing 33 thereby providing a cavity 44 for holding lubricant. Likewise, a washer 45 is provided between plate 31 and bearing 33 to provide a cavity 46 for holding lubricant. Bushing 34 is provided with groove 47 and, likewise, outer bearing 35 is provided with groove 48, and grooves 47 and 48 retain lubricant so that shaft 36 is kept well lubricated between washers 43 and 45.

Figure 2:
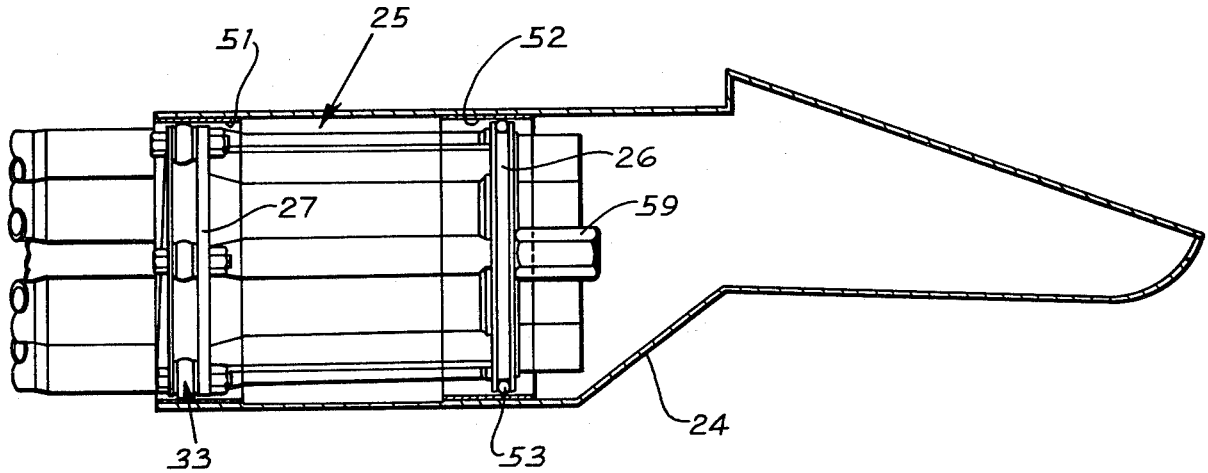
FIG. 2 is a side view, partly in section, showing a muzzle clamp assembly within a gun blast diffuser.
Figure 3:
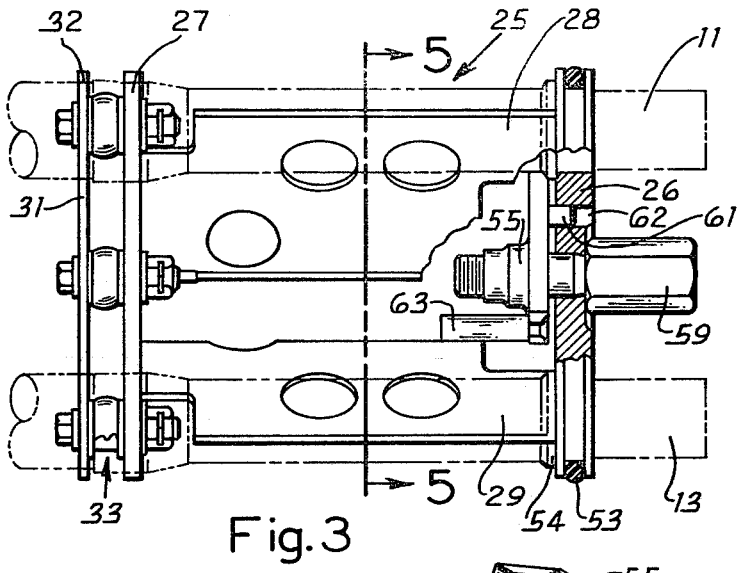
FIG. 3 is a side view, partly broken away, showing a muzzle clamp around a plurality of gun barrels.
Figure 5:
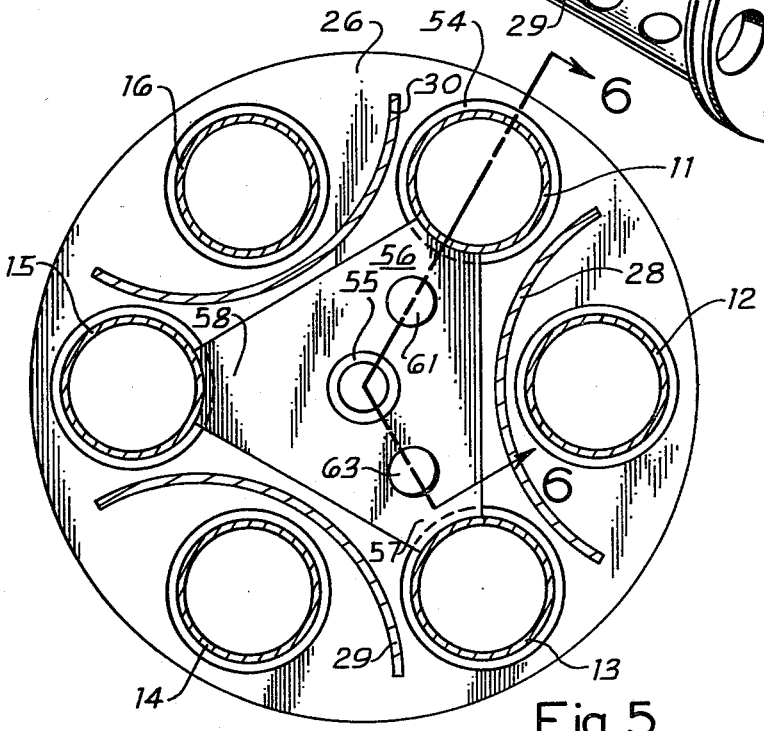
FIG. 5 is a sectional view taken on line 5—5 of FIG. 3.
Figure 6:
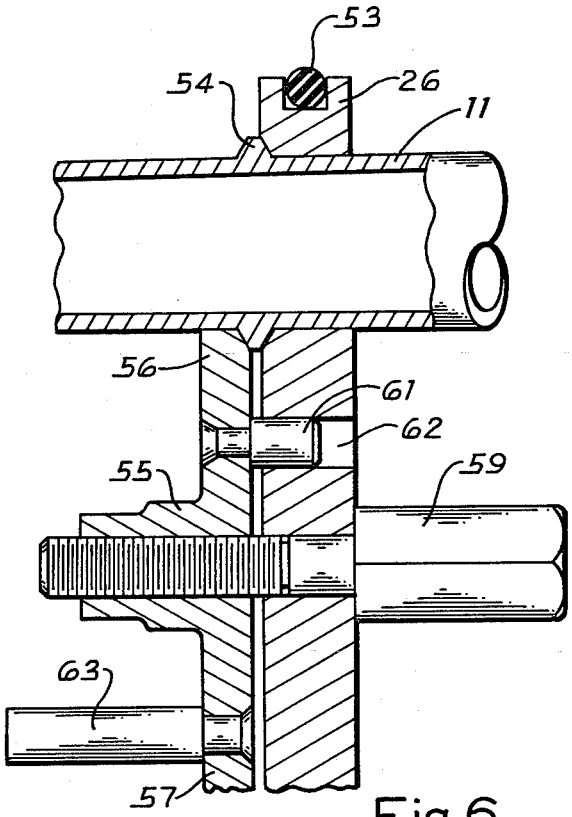
FIG. 6 is a sectional view taken on line 6—6 of FIG. 5.

Referring now to FIG. 2 of the drawings, blast diffuser 24 is provided with a pair of circular seal strips 51 and 52, and seal strip 51 is engaged by the six bearings 33. A gasket 53 is provided around the periphery of front plate 26 and engages seal strip 52 to provide a gas seal. As best shown in FIGS. 5 and 6 of the drawings, front plate 26 contacts flanges 54 which are provided on the six gun barrels 11–16, and a triangular shaped locking nut 55 has arms 56, 57, and 58 which contact three gun barrels 11, 13, and 15. A bolt 59 threadedly engages locking nut 55 and draws locking nut 55 and plate 26 together to clamp muzzle clamp 25 to gun barrels 11, 13, and 15. An alignment pin 61 is provided on nut 55 and engages hole 62 in plate 26 and also a handle 63 is provided on nut 55 to facilitate engagement with bolt 59.

Figure 4:
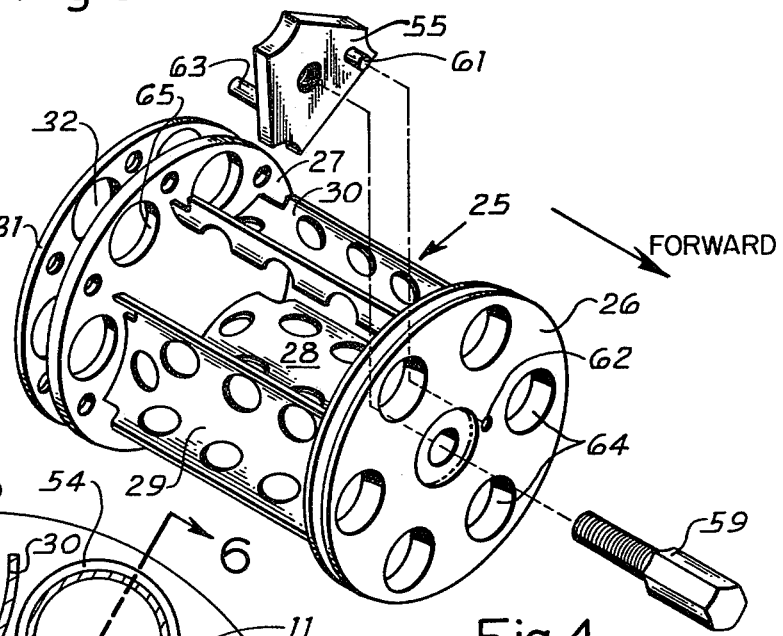
FIG. 4 is a perspective view of a muzzle clamp.

As best shown in FIG. 4 of the drawings, front plate 26 is provided with six clearance holes 64 and aft plate 27 is also provided with six clearance holes 65. Holes 32, in plate 31, and holes 64 and 65 are aligned so that the six gun barrels are supported and locked together by muzzle clamp 25 which, in turn is rotatably mounted in blast diffuser 24.

In operation, during firing of the gun, barrels 11–16 are rotated and successively fired. Muzzle clamp 25 helps to retain the barrel in proper firing position and rotatably supports barrels 11–16.

Obviously many modifications and variations of the present invention are possible in the light of the above teachings. It is therefore to be understood that the invention may be practiced otherwise than as specifically described.

I claim:

1. In a Gatling type gun having a plurality of rotatable gun barrels, an improvement comprising, a stationarily mounted blast diffuser attached to said gun and extending around the forward ends of said gun barrels, said blast diffuser having first and second seal strips spaced apart inside said blast diffuser, and a barrel clamp secured to each of said plurality of gun barrels and rotatably supported by said blast diffuser, said barrel clamp having first and second supporting elements engaging said seal strips.

2. In a Gatling type gun according to claim 1, the improvement wherein:

said first and second supporting elements are attached together.

3. In a Gatling type gun according to claim 1, the improvement wherein:

said first supporting element includes a plurality of roller bearings engaging said first seal strip.

4. In a Gatling type gun according to claim 1, the improvement wherein:

said second supporting element includes gas sealing means engaging said second seal strip.

5. In a Gatling type gun having a plurality of rotatable gun barrels and a stationarily mounted blast diffuser attached to said gun and extending around the forward ends of said gun barrels, a barrel clamp comprising, a first plate having a plurality of holes for receiving said gun barrels, a second plate having a plurality of holes for receiving said gun barrels, means connecting said first and second plates, a plurality of roller bearings attached to said first plate and engaging said blast diffuser, gas sealing means attached to said second plate and engaging said blast diffuser, and means for locking said second plate to at least one of said gun barrels whereby said gun barrels are clamped together and rotatably supported by said blast diffuser.

* * * * *